US006618878B1

(12) United States Patent
McCoy, Jr et al.

(10) Patent No.: US 6,618,878 B1
(45) Date of Patent: Sep. 16, 2003

(54) JESUS MANGER BABY SLEEP PROTECTOR

(76) Inventors: Burrell McCoy, Jr, 501 S. 11th St., Monroe, LA (US) 71202; Ernestine McCoy, 501 S. 11th St., Monroe, LA (US) 71202

( * ) Notice: Subject to any disclaimer, the term of this patent is extended or adjusted under 35 U.S.C. 154(b) by 0 days.

(21) Appl. No.: 10/230,117

(22) Filed: Aug. 29, 2002

(51) Int. Cl.[7] ..... A47D 7/00; A47D 13/06
(52) U.S. Cl. ..... 5/95; 5/93.1
(58) Field of Search ..... 5/95, 96, 93.1

(56) References Cited

U.S. PATENT DOCUMENTS

| | | | | | |
|---|---|---|---|---|---|
| 1,463,459 | A | * | 7/1923 | Comstock | 5/99.1 |
| 2,128,978 | A | * | 9/1938 | Akin | 5/93.1 |
| 2,528,749 | A | * | 11/1950 | Hill | 5/99.1 |
| 2,553,087 | A | * | 5/1951 | Hanson | 5/93.1 |
| 3,708,808 | A | | 1/1973 | Irby | 5/95 |
| 4,491,992 | A | * | 1/1985 | Wittman | 5/93.1 |
| 4,670,923 | A | * | 6/1987 | Gabriel et al. | 5/424 |
| 4,999,863 | A | | 3/1991 | Kane | 5/98.1 |
| 5,233,710 | A | | 8/1993 | Bernard | 5/424 |
| 5,406,655 | A | * | 4/1995 | Sahlin | 4/572.1 |
| 5,604,941 | A | | 2/1997 | Roman | 5/95 |
| 5,632,052 | A | * | 5/1997 | Michel | 5/93.1 X |
| 5,855,031 | A | * | 1/1999 | Swift, Jr. | 5/93.1 |
| D414,615 | S | | 10/1999 | Sedlack | D6/333 |

OTHER PUBLICATIONS

Untitled Document—One Step Ahead®—Snuggle Nest© 2000.

Untitled Document—One Step Ahead®—Bedside Co–Sleeper© 2000.

* cited by examiner

*Primary Examiner*—Robert G. Santos
(74) *Attorney, Agent, or Firm*—Reginald F. Roberts, Jr.

(57) ABSTRACT

A sleep protector for preventing crib deaths. The sleep protector is cooperable with conventional cribs or beds, and is made up of a series of interconnected pipe members forming a support structure. The structure of the sleep protector is characterized as having a grid-like base configuration featuring a number of upstanding supports along each side, and a further grid at the head and foot of the grid work.

2 Claims, 2 Drawing Sheets

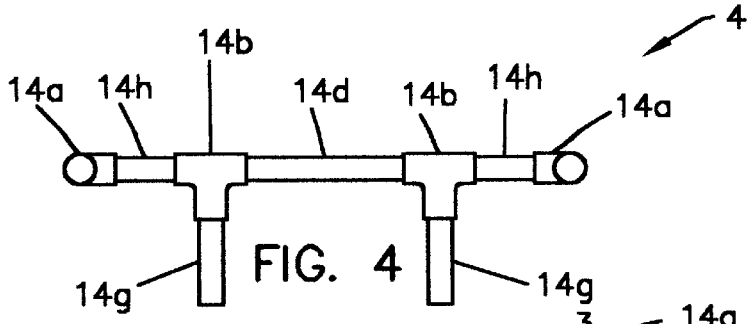
FIG. 4
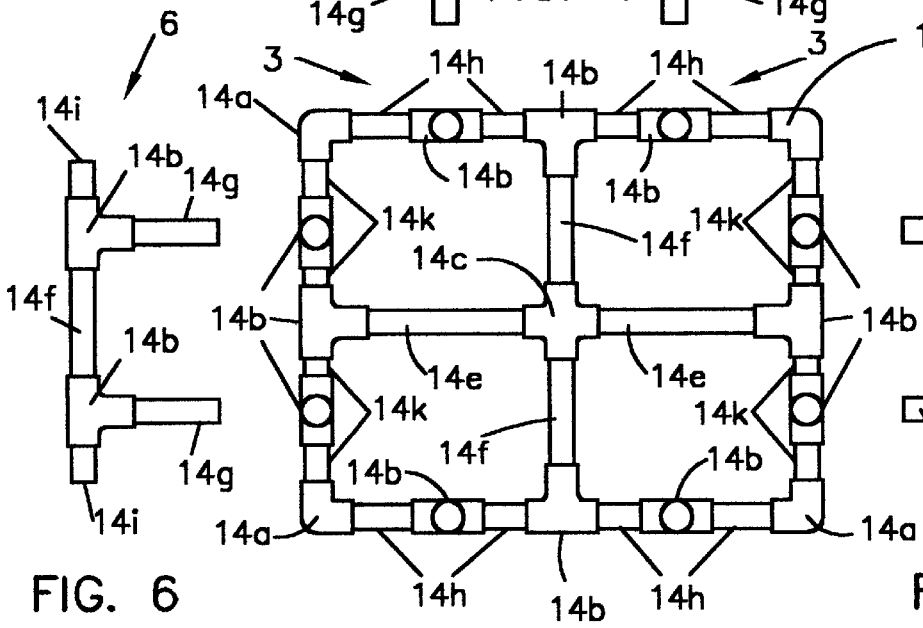
FIG. 6
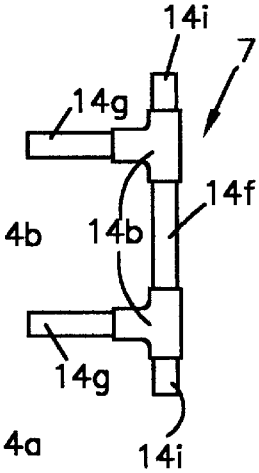
FIG. 7
FIG. 3
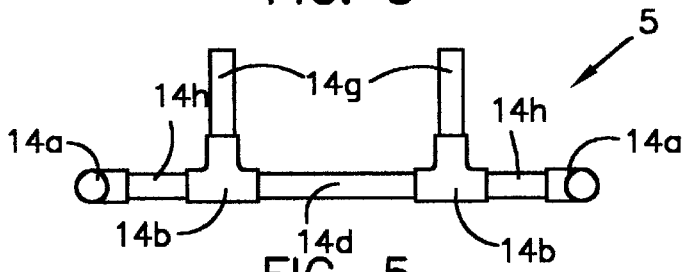
FIG. 5
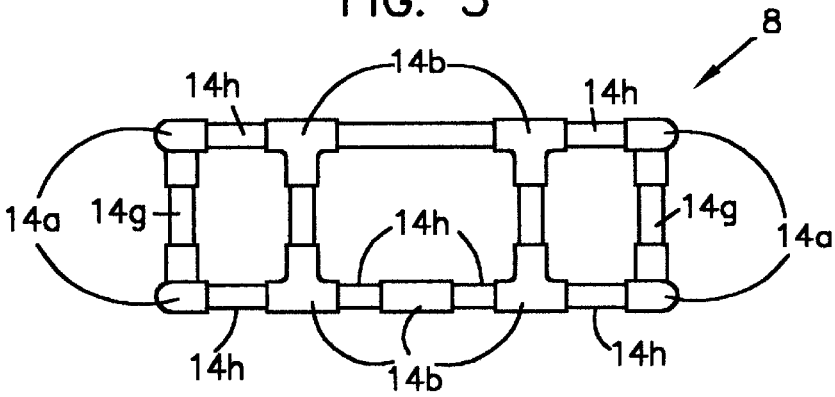
FIG. 8

JESUS MANGER BABY SLEEP PROTECTOR

CROSS-REFERENCE TO RELATED DOCUMENT

Disclosure Document No. 486728, filed Jan. 2, 2001, is hereby incorporated by reference.

BACKGROUND OF THE INVENTION

1. Field of the Invention

The present invention relates to sleep protection. More specifically, the invention relates to the protection from accidents of sleeping infants.

2. Scope of the Prior Art

U.S. Pat. No. 3,708,808 to Irby discloses an infant restrainer comprising a portable, collapsible device that may be placed on a surface such as a bed, erected, and an infant placed therein whereby the infant is precluded from rolling out of the confined area protected by the device.

U.S. Pat. No. 5,604,941 to Roman discloses a portable crib for a sofa. The crib includes a front section having inner and outer gates. The inner gate is slidably received within the outer gate. The device includes a pair of side sections, each section having an inner and an outer gate. The inner gate is slidably received within the outer gate. Each outer gate is secured to the inner gate and to the outer gate of the front section. A sofa securement mechanism is hingedly coupled with a lower distal end of each inner gate and outer gate of the front section.

U.S. Pat. 4,999,863 to Kane discloses a portable collapsible baby bed and carrying bag which includes a base panel foldable about a lateral axis. The base panel has a bottom and a top surface, engagement means for releasably securing together the base panel with the bottom surface facing itself on opposite sides of the lateral axis in the surface and a vertical panel. The vertical panel provides a restraining wall. The retainer is connected to other similar restrainers at an angle of ninety degrees to form a rectangular crib area for an infant.

U.S. Des. Pat. No. 414,615 to Sedlack discloses an ornamental design for an infant car bed shell.

All of the above prior-art patents fail to disclose a sleep protector for infants which is cooperable with conventional cribs or beds, which is easily, quickly, and efficiently fabricated, assembled, and disassembled, and which has parts which are easily, quickly, and efficiently replaced. The present invention provides such a protector.

SUMMARY OF THE INVENTION

In general, the present invention provides an infant sleep protector. The sleep protector comprises a series of interconnected pipe members forming a support structure. The structure has a grid-like base configuration comprising a plurality of upstanding support members along each side, and a further grid at the head and foot of the grid work. The sleep protector is cooperable with conventional cribs or beds.

BRIEF DESCRIPTION OF THE DRAWINGS

FIG. 3 is a plan view of a bottom frame of the infant sleep protector shown in FIGS. 1 and 2.

FIGS. 4 and 5 are side elevations of side and top rails of the infant sleep protector shown in FIGS. 1 and 2.

FIGS. 6 and 7 are end views of end rails of the infant sleep protector shown in FIGS. 1 and 2.

FIG. 8 is a side elevation of one set of the side and top rails connected to one side of the bottom frame of the infant sleep protector shown in FIGS. 1 and 2.

DETAILED DESCRIPTION OF THE INVENTION

Figure 1:
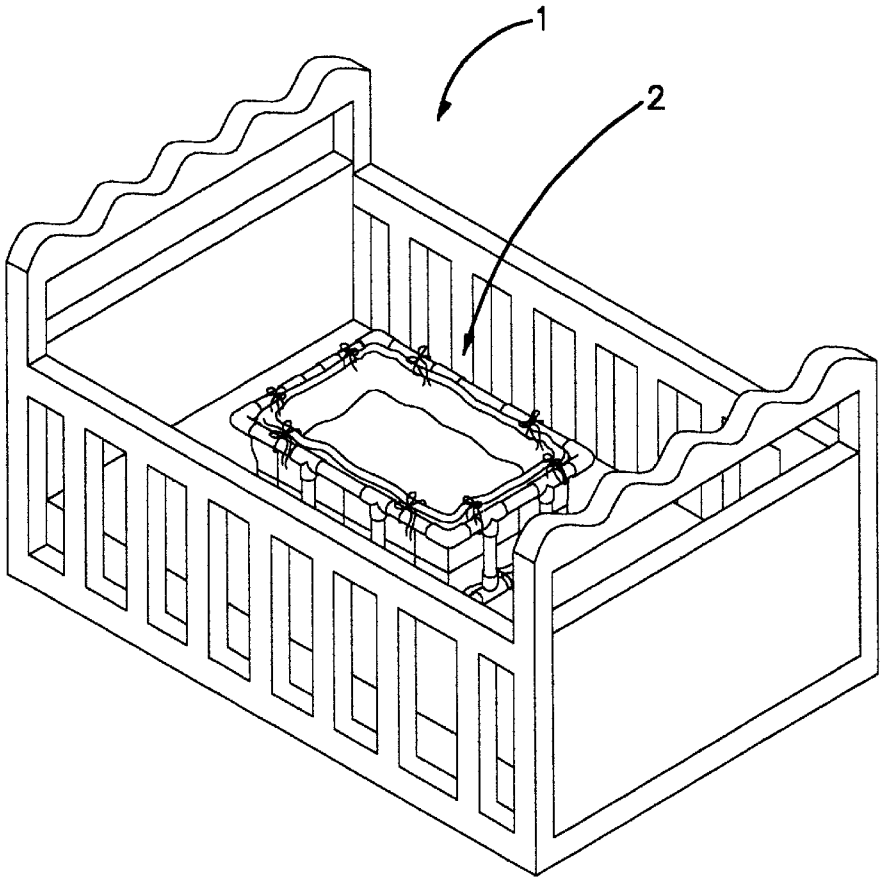
FIG. 1 is an isometric view of an infant sleep protector, made in accordance with the principles of the present invention, installed in a crib.

More specifically, reference is made to FIG. 1, in which is shown a crib, generally designated by the numeral 1, in which is installed an infant sleep protector, made in accordance with the principles of the present invention, and generally designated by the numeral 2. This drawing illustrates an important advantage of the present invention over prior-art sleep protectors for infants; viz., its cooperability with conventional cribs and/or beds. To understand how the infant sleep protector 2 provides this cooperability, reference is made to FIG. 2, in which is shown an enlarged isometric view of the infant sleep protector 2.

Figure 2:
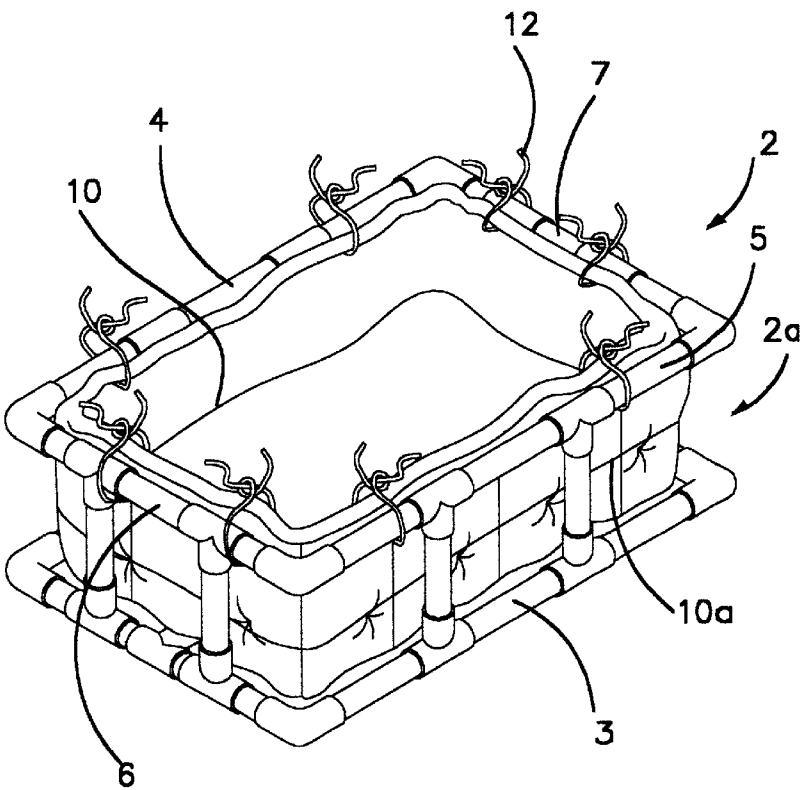
FIG. 2 is an enlarged isometric view of the infant sleep protector shown in FIG. 1.

As seen in FIG. 2, the infant sleep protector 2 comprises a bottom frame 3, side and top rails 4, 5, and end rails 6,7 which, in combination comprise a frame 21 for the infant sleep protector 2; a padded mattress 10 having support webbing 10*a*, and tie straps 12 for securing the mattress 10 to the frame 2*a*of the infant sleep protector 2.

The detailed structure of the frame 21 is shown in FIGS. 3 to 8, to which reference is now made.

FIG. 3 is a plan view of the bottom frame 3 of the infant sleep protector 2. The bottom frame 3 comprises a plurality of interconnected members including L-shaped members 14*a*, T-shaped members 14*b*, a cross member 14*c*, and elongated members 14*e*, 14*f*, 14*h*, and 14*i*.

FIG. 4 is a side elevation of a first set 4 of the side and top rails of the infant sleep protector 2. FIG. 5 is a side elevation of a second and matching set 5 of the side and top rails of the infant sleep protector 2. Each set 4, 5 of the side and top rails comprises a plurality of interconnected members including an elongated member 14*d*, two elongated members 14*g*, two elongated members 14*h*, and two L-shaped members 14*a*.

FIG. 6 is an end view of a first set 6 of the end rails of the infant sleep protector 2. FIG. 7 is an end view of a second and matching set 7 of the end rails of the infant sleep protector 2. Each set 6,7 of the end rails comprises a plurality of interconnected members including two elongated member 14*i*, two elongated members 14*g*, one elongated members 14*f*, and two T-shaped members 14*b*.

FIG. 8 is a side elevation of one set of the side and top rails 4,5 connected to the bottom frame 3 of the infant sleep protector 2. The entire assembled frame 21 of the infant sleep protector 2 comprises the members shown in FIGS. 3 to 8 interconnected as shown in FIG. 2;

Preferably, the frame 2*a* is made from pipe. Even more preferably, the frame 2*a* is made from pipe having the composition of an organic polymer. Even more preferably, the frame 2*a* is made from poly(vinyl chloride) pipe (PVC pipe). Most preferably, the frame 2*a* is made from PVC pipe having an inner diameter (ID) of about one-half inch.

Preferably,, the length of the elongated member 14*d* is about ten and one-half inches, the length of the elongated member 14*e* is about ten and one-quarter inches, the length of the elongated member 14*f* is about five and one-half inches, the length of the elongated member 14*g* is about three and three-quarter inches, the length of the elongated member 14*h* is about four and one-half inches, and the length of the elongated member 14*i* is about two inches. All of the elongated members are beneficially cut from one-half inch ID PVC pipe. The required number of each elongated member to complete the assembled frame 2*a* is: 14*d*, two; 14*e*, two; 14*f*, four; 14*g*, eight; 14*h*, twelve; 14*i*, twelve. The length of the assembled frame 21 is about two feet and three-eighths inch, the width about thirteen and three-quarter inches, and the height about six and one-half inches. The frame 2*a* is assembled using the elongated members 14*d* to 14*i* interconnected by the L-shaped members 14*a*, the T-shaped members 14*b*, and the cross member 14*c*. Eight L-shaped members 14*a*, sixteen T-shaped members 14*b*, and one cross member 14*c* are required for assembly. In a preferred embodiment the members are interconnected by wedging them together, and they are held together by friction.

The mattress 10 comprises a mat and a pad made from plastic foam. The mat is preferably about twenty-one inches long, eleven inches wide, and one inch thick. The pad is preferably about five feet four inches in length, three inches in width, and one inch in thickness. The mattress 10 further comprises a mat support and a pad support which in combination provide the support webbing 10*a* shown in FIG. 2. The mat support comprises four plastic webs, each web measuring about eleven inches in length and one-half inch in width, and including one-eighth inch holes constructed and arranged to be secured to the elongated members 14*h* with screws. The pad support comprises a plastic web measuring about five feet four inches by one-half inch, and includes one-eighth inch holes constructed and arranged to be secured to the elongated members 14*g* with screws. The fabrication of the frame 2*a* of the sleep protector 2 from standard pipe confers tremendous advantages. The unassembled parts are readily obtainable; they are replaceable, and can be easily, speedily, and efficiently changed out from the assembled frame. The frame 2*a* is easily, quickly, and efficiently assembled and disassembled because all of the parts fit one another.

We claim:

1. An infant sleep protector, comprising:

(a) a planar base defining an exterior first rectangle circumscribing a grid of interior congruent second, third, fourth, and fifth interlocking rectangles, two sides of each of the interior rectangles forming in combination the exterior first rectangle, and two other sides of each of the interior rectangles connecting four sides of the exterior first rectangle to one another, forming a grid work constructed and arranged to provide support for a padded mattress;

(b) an upper railing defining a sixth rectangle parallel to and congruent with the first rectangle; and (c) a plurality of elongated members perpendicular to the first and sixth rectangles, the elongated members connecting the first and sixth rectangles to one another and the upper railing to the base, to form a structure constructed, arranged, and sized for disposition within a conventional cribs or upon a conventional beds.

2. The infant sleep protector of claim 1, wherein the infant sleep protector has a length of about two feet and three eighths inch, a width of about thirteen and three-quarter inches, and a height of about six and one-half inches.

* * * * *